United States Patent [19]

Casavant

[11] 4,052,062

[45] Oct. 4, 1977

[54] COMBINATION RACKET PRESS AND COVER

[75] Inventor: Roger M. Casavant, Winsted, Conn.

[73] Assignee: Product Explorations Incorporated, Ridgefield, Conn.

[21] Appl. No.: 671,070

[22] Filed: Mar. 29, 1976

[51] Int. Cl.[2] ..... A63B 49/16; A63B 49/18

[52] U.S. Cl. ..... 273/74; 150/52 G; 206/315 B

[58] Field of Search ..... 273/74, 76, 82 R, 82 A; 150/52 G; D34/5 ST; 206/315 B

[56] References Cited

U.S. PATENT DOCUMENTS

| | | | |
|---|---|---|---|
| 1,197,332 | 9/1916 | Bates | 273/74 |
| 2,166,950 | 7/1939 | German et al. | 273/82 A |
| 3,604,706 | 9/1971 | Baukney | 273/74 |
| 3,674,268 | 7/1972 | Shellman | 273/76 |
| 3,968,875 | 7/1976 | Koehnle | 273/74 X |
| D. 239,045 | 3/1976 | Rood et al. | 273/74 X |

FOREIGN PATENT DOCUMENTS

| | | | |
|---|---|---|---|
| 579,197 | 6/1933 | Germany | 273/74 |
| 12,471 of | 1905 | United Kingdom | 273/74 |
| 1,226 of | 1909 | United Kingdom | 273/74 |
| 20,804 of | 1909 | United Kingdom | 273/74 |
| 245,607 | 1/1926 | United Kingdom | 273/74 |
| 6,281 of | 1908 | United Kingdom | 273/74 |
| 20,804 of | 1909 | United Kingdom | 273/74 |
| 162,588 | 5/1921 | United Kingdom | 273/74 |

OTHER PUBLICATIONS

"The Sporting Goods Dealer", May 1975, p. 143.

*Primary Examiner*—Richard J. Apley
*Attorney, Agent, or Firm*—Buckles and Bramblett

[57] ABSTRACT

A combination racket press and cover which is formed from two identical molded plastic halves. Integrally molded into each half are ribs aligned in the same geometry as the members of a conventional press. The two halves are held in place on opposite sides of a racket head by means of quick release fasteners.

7 Claims, 6 Drawing Figures

COMBINATION RACKET PRESS AND COVER

BACKGROUND OF THE INVENTION

The basic concept of a combination racket cover and press for a stringed racket, such as a tennis racket, is not new. Examples of such devices will be found, for example, in the following United States patents:

U.S. Pat. No. 1,925,330 Leisner
U.S. Pat. No. 1,989,577 Watkins
U.S. Pat. No. 3,079,156 Baukney
U.S. Pat. No. 3,343,838 Baukney
U.S. Pat. No. 3,604,706 Baukney The known prior art devices, however, are lacking in certain combinations of features which it would be desirable to incorporate into a commercially successful device. One such feature, for example, is a minimal number of parts with a single molded part serving a dual function. Another desirable feature is that the device should be capable of exerting forces upon a contained racket substantially equal to those of a conventional wooden press. Still another desirable feature would be for the device to be readily and simply mounted upon, and removed from, the head of a racket. It is also desirable that the device be as inexpensive as possible consistent with retaining the above features.

Accordingly, it is a primary object of the present invention to provide an improved combination racket press and cover which is formed of two identical molded halves. Other objects are to provide such a device which will exert forces on a racket substantially equal to those of a conventional press; which is easily removed and repositioned on a racket head; and which is inexpensive to manufacture. The manner in which the foregoing objects are achieved will be more apparent from the following description and appended claims.

SUMMARY OF THE INVENTION

A combination cover and press for a stringed racket comprising identical first and second molded halves. Each half includes a major wall which is adapted to cover a face of the racket and a marginal wall which extends from one surface thereof to encircle the edge of the racket. The marginal wall defines an opening for receiving the handle of the racket and includes an exposed edge. The exposed edge has at least two diametrically opposed first and second portions configured to mate with corresponding second and first portions of the marginal wall edge of the other half. Molded racket clamping ribs extend from the major wall of each half. Means are included for clampingly engaging the first and second molded halves against opposite sides of the head of the racket.

DESCRIPTION OF THE PREFERRED EMBODIMENT

Figure 1:
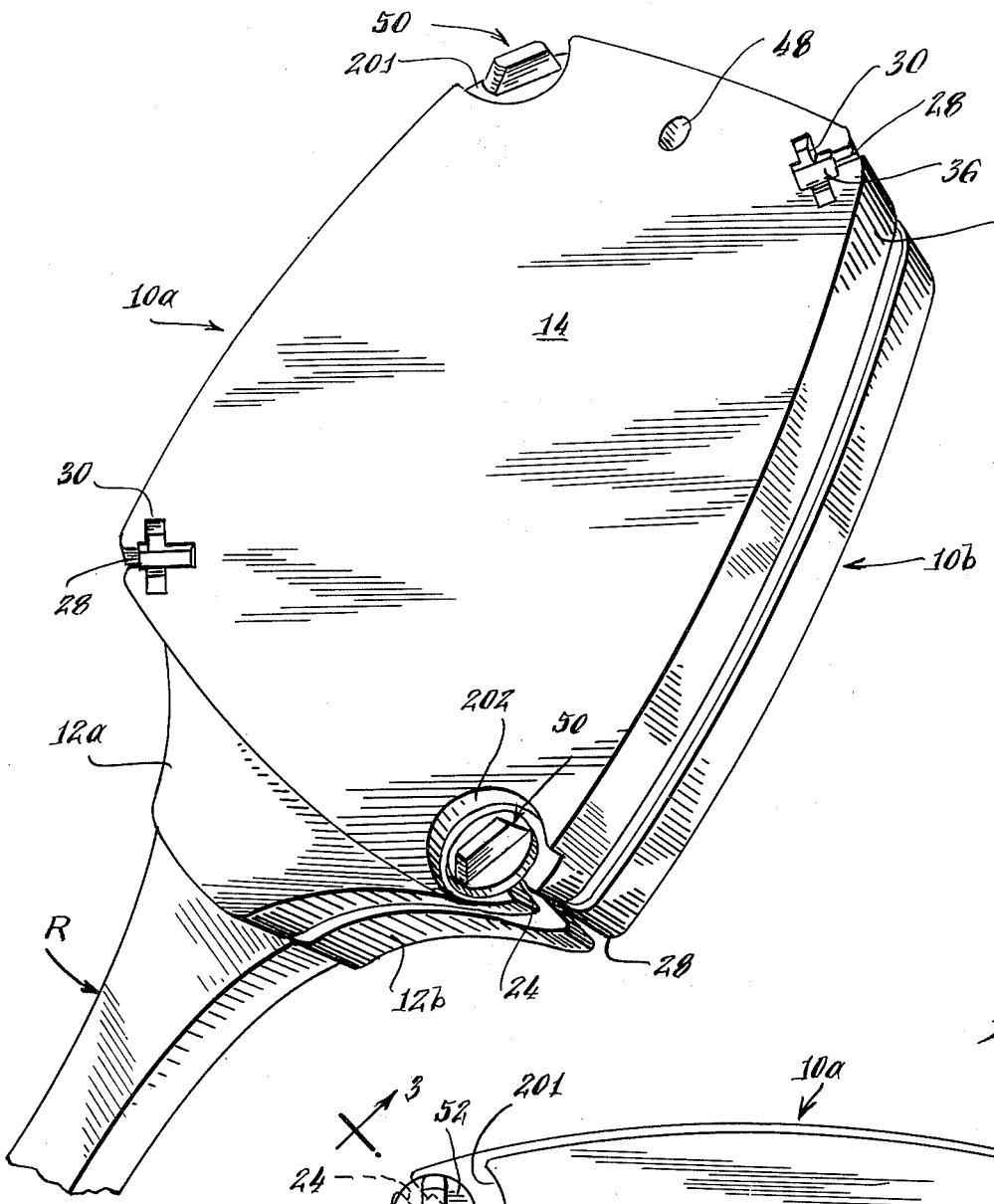
FIG. 1 is a perspective view of a combination racket press and cover in accordance with the present invention.
Figure 2:
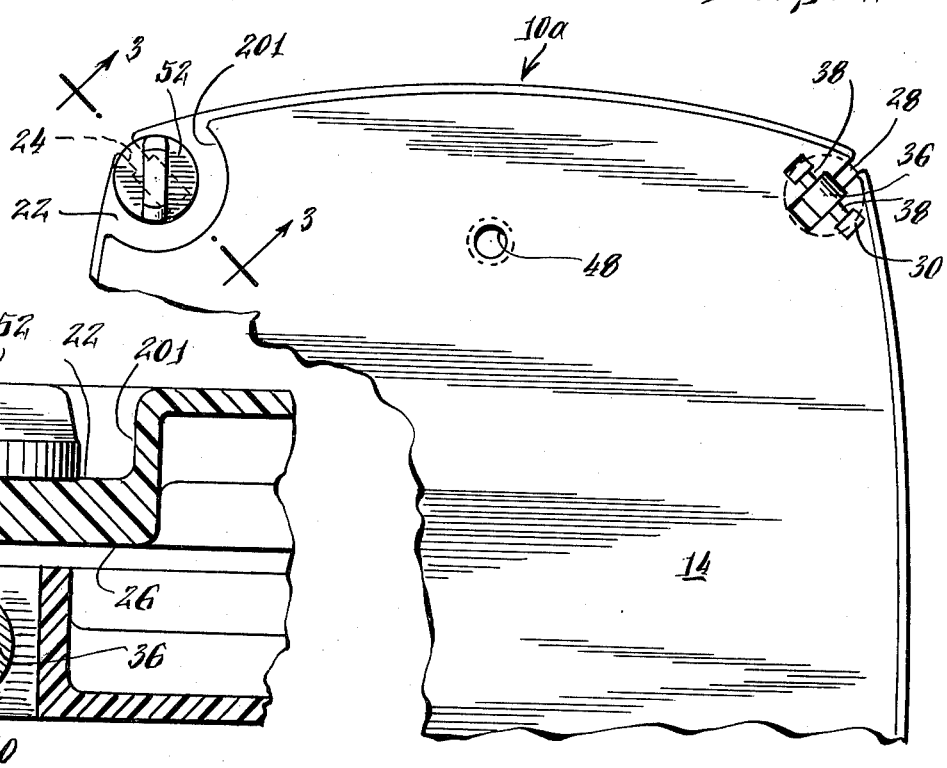
FIG. 2 is a partial view of one end of the device illustrated in FIG. 1.
Figure 6:
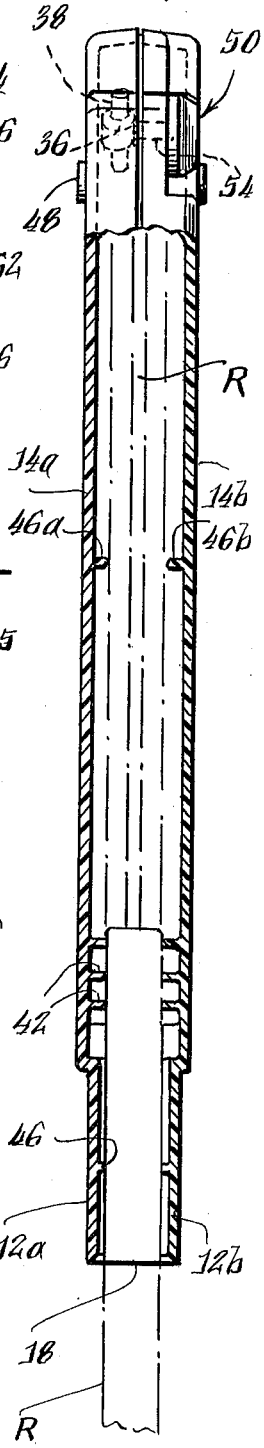

With particular reference to FIG. 1, there is illustrated a combination press and cover in accordance with this invention mounted upon the head of a tennis racket R. The cover comprises two identical molded plastic halves 10*a, b.* (As the halves are identical in all respects, the letters "*a*" and "*b*" will be employed in the following description only where necessary to distinguish between structural elements of the two halves.) The halves are essentially trapezoidal in shape and each includes a necked-down extension 12 for enclosing the racket handle. Each half includes a major wall portion 14 bounded by a marginal wall 16 which terminates at the necked-down portion 12 to define an opening 18 (FIG. 6) for receiving the handle of the racket R. The marginal wall 16 extends substantially perpendicularly from the major wall 14 and terminates in one of two edge configurations 161 and 162.

Figure 5:
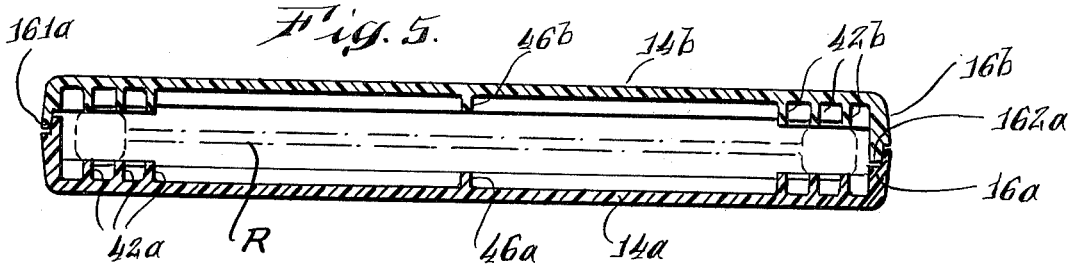
FIG. 5 is a cross section taken along the line 5—5 of FIG. 4 illustrating both half members; and, FIG. 6 is a cross section taken substantially along the line 6—6 of FIG. 4, also showing both half members.
Figure 4:
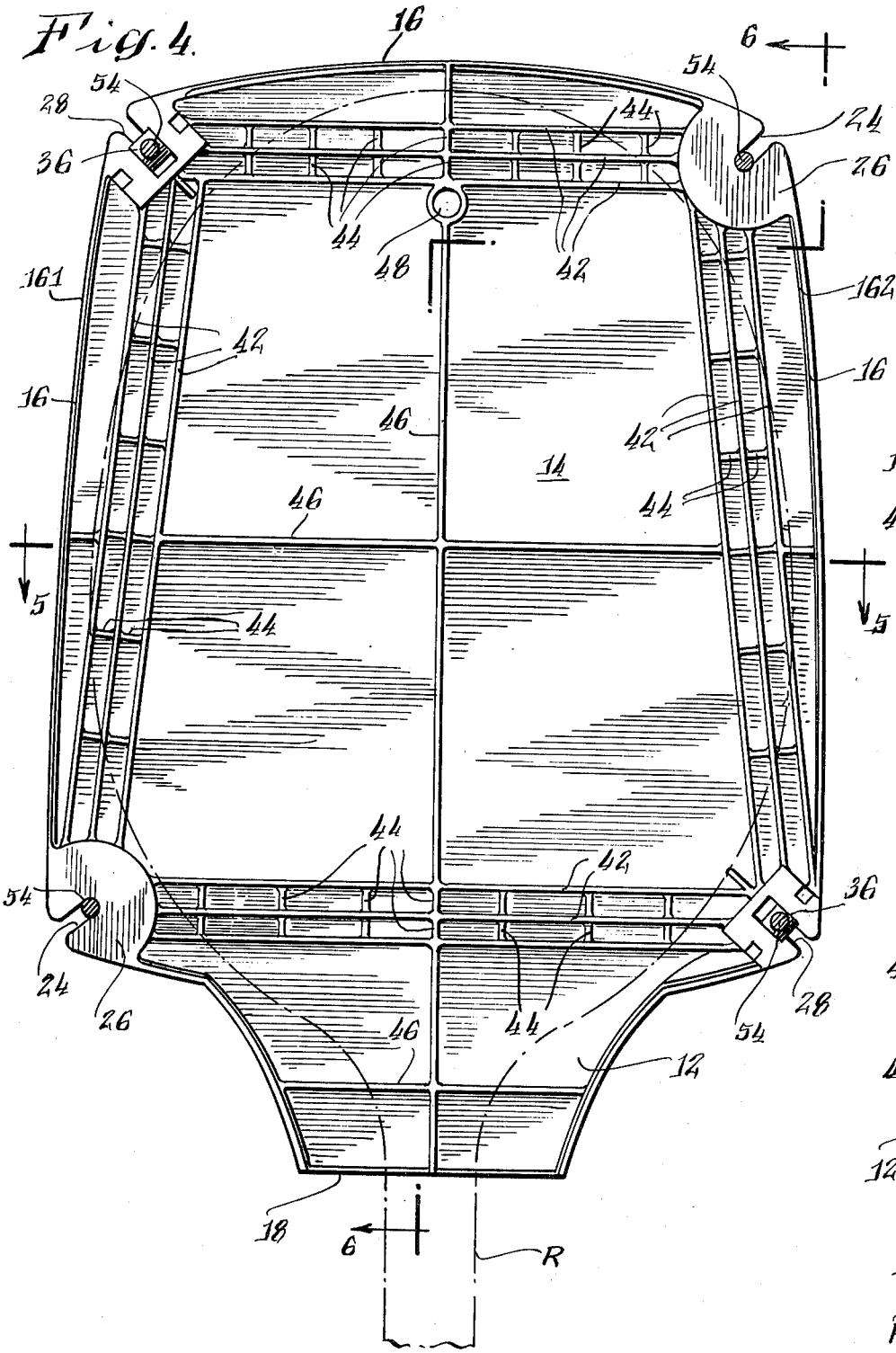
FIG. 4 is an elevational view of the inner surface of one of the half members forming the device of the present invention.

As viewed in FIG. 4, edge 161 extends from the vertical center line at the top of the illustration, around the left periphery of the molded half to the opening 18. The edge 162 extends in a similar fashion from the vertical center line around the right periphery of the molded half to opening 18. The edge portions 161, 162 are designed to mate so that when two identical molded halves are placed together, as illustrated in FIG. 5, the edges will interlock as illustrated.

The outer surface of each of the molded halves 10 defines, at diagonally opposite corners, semicircular recesses 201, 202, each of which encircles a planar bearing surface 22 which in turn defines a slot 24. The slots 24 interrupt the marginal wall 16 and extend to the outer surface of the respective corners. The molded material which forms the bearing surface 22 on the outside of the cover half also defines an internal boss 26. Each of the two remaining diagonally opposite corners of ach half defines slots 28. On either side of each of slots 28 are aligned tapered keyways 30 (FIG. 3) which terminate in cylindrical recesses 32. A swing nut 34 is mounted within each of the slots 28 and recesses 32. It comprises a central cylindrical body 36 within recess 28 and a pair of axially extending cylindrical pivots 38 which are snapped into the recesses 32 through the keyways 30 formed in the resilient plastic. The cylindrical body 36 defines a tapped passage 40 perpendicular to its longitudinal axis.

Molded internally of each half of the device of this invention are a plurality of pressure ribs 42, arranged in sets of three and corresponding in geometry to a conventional wooden press. Each set of ribs 42 is reinforced by transverse stiffening ribs 44. The ribs 42 have a height sufficient to engage the frame of a tennis racket clamped between two shell halves. In addition, there are provided ribs 46 for stiffening the wall 14. A subsidiary feature of the device of the invention is an opening 48 which is molded to extend through the wall 14.

Figure 3:
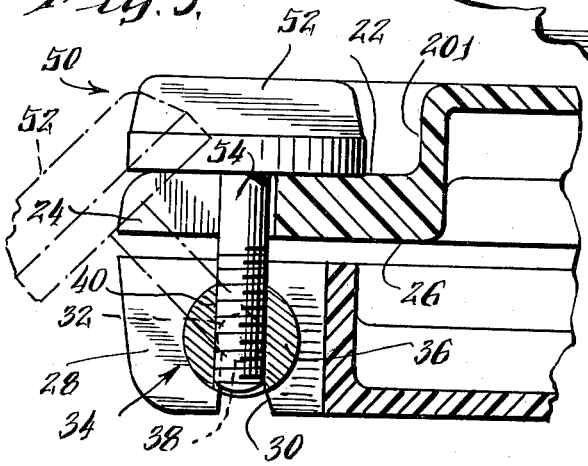
FIG. 3 is an enlarged cross section taken substantially along the line 3—3 of FIG. 2.

In employing the device of this invention, two identical molded halves 10*a,* 10*b* are positioned on either side of the head of a racket and a thumb screw 50 having the usual head 52 and threaded shank 54 is threaded into the corresponding cylindrical body 36 of each of the swing nuts 34. By tightening these thumb screws while in the configuration illustrated in FIG. 3, the molded halves are caused to be clamped together whereby the ribs 42 exert pressure against the head of the racket R to prevent warping while, at the same time, completely enclosing the racket head for protective purposes. The handle of the racket, however, extends outwardly from the device for carrying purposes. A cord may be run through the openings 48 for purposes of hanging or otherwise securing the cover to an external object. In order to release the racket, it is merely necessary to loosen the thumb screws 50 and pivot them outwardly as illustrated in FIG. 3 by virtue of the swing nuts 34 rotating in the recesses 32. In this fashion, the device may be easily and quickly removed from, or repositioned over, the racket head.

It is believed that the many advantages of this invention will now be apparent to those skilled in the art. In effect, only three separate elements are required to form a complete combination racket press and cover. These comprise a single molded half 10, of which two are required, the configuration being such that when one is reversed and mated to the other, the edges 161 and 162 of the marginal walls 16 interlock. Each of the devices carries two swing nuts which are also identical to one another and four identical thumb screws 50 complete the assembly. It will also be apparent that a number of variations and modifications may be made in this invention without departing from its spirit and scope. Accordingly, the foregoing description is to be construed as illustrative only, rather than limiting. This invention is limited only by the scope of the following claims.

I claim:

1. A combination cover and press for a stringed racket which comprises: identical first and second molded halves, each including a major wal adapted to cover a face of said racket and a marginal wall extending from one surface thereof to encircle the edge of said racket, said marginal wall defining an opening therein for receiving the handle of said racket and including an exposed edge, at least two diametrically opposed first and second portions of said edge being configured to mate with corresponding second and first portions of the marginal wall edge of the other of said halves, and molded racket clamping ribs extending from said one surface of said major wall; and first and second latch means pivotally secured to each of said halves for selective engagement with the other of said halves for clampingly engaging said halves against opposite sides of the head of said racket.

2. The article of claim 1 wherein each of said molded halves defines first and second sockets retaining therein said respective first and second latch means.

3. The article of claim 2 wherein each of said latch means comprises: a nut pivotally retained in each of said sockets; and a screw including a shank and a head and engageable with said nut and the other of said molded halves.

4. The article of claim 3 wherein each of said molded halves defines a plurality of slots extending through said marginal wall and into said major wall to enclose the shank of said screw.

5. The article of claim 1 wherein the shape of said major wall is essentially trapezoidal.

6. The article of claim 5 wherein said clamping ribs extend substantially linearly between the corners of said trapezoidal shape and within the confines of said marginal wall.

7. The article of claim 1 wherein each of said first and second edge portions extends substantially the length of one half of its marginal wall.

* * * * *